United States Patent [19]

Pavenick

[11] 3,993,226

[45] Nov. 23, 1976

[54] DISPENSER FOR EXTRUDABLE MATERIALS

[76] Inventor: Stanford Pavenick, 341 Scotland Road, South Orange, N.J. 07079

[22] Filed: Jan. 2, 1976

[21] Appl. No.: 646,376

[52] U.S. Cl. ..... 222/327; 222/390
[51] Int. Cl.[2] ..... B67D 5/42
[58] Field of Search ..... 222/390, 327

[56] References Cited

UNITED STATES PATENTS

| | | | |
|---|---|---|---|
| 1,183,185 | 5/1916 | Gill | 222/390 X |
| 1,770,473 | 7/1930 | Javins | 222/390 X |
| 2,998,167 | 8/1961 | Boehm | 222/390 X |

*Primary Examiner*—Allen N. Knowles
*Attorney, Agent, or Firm*—Kirschstein, Kirschstein, Ottinger & Frank

[57] ABSTRACT

A dispenser unit includes a container formed from a tubular member having a constant transverse cross-sectional configuration which is adapted to contain an extrudable material. One end of the tube is closed by an end wall having a discharge nozzle therein which can be selectively sealed by a closure cap. The other end of the tubular member is sealed by an air-tight end wall. Disposed within the tubular member is a compression arrangement which includes a threaded shaft adapted for rotational non-longitudinal motion within the tubular member and a compression element mounted on the shaft and adapted for longitudinal motion within the tubular member when the threaded shaft rotates to exert an expelling or compression force on the extrudable material. An operating structure adapted for longitudinal non-rotational reciprocating motion on a support associated with the container has an idle position and an actuated position, and is constantly urged to its idle position. A kinematic translating train in operative engagement with the operating structure and the compression arrangement converts the longitudinal non-rotational motion of the operating structure from its idle position to its actuated position to rotational motion of the shaft and permits the operating structure to return to its idle position without rotational motion of the shaft.

5 Claims, 13 Drawing Figures

DISPENSER FOR EXTRUDABLE MATERIALS

BACKGROUND OF THE INVENTION

1. Field of the Invention

The invention relates to a dispenser unit and more particularly to a dispenser unit for extrudable material in which the dispensed material is metered so that for each actuation of the dispenser unit a specifically predetermined amount of material is dispensed and wherein the dispenser unit or the portion containing the extrudable material is dispensable.

2. Prior Art

The concept of holding an extrudable material in a container portion of a dispenser which is provided with a compression means which can be operated to exert an expelling or compression force on the extrudable material and thereby force the extrudable material through a nozzle in the container portion is well known. Such devices are described in U.S. Pat. Nos. 1,770,473 and 1,802,113 inter alia.

U.S. Pat. No. 1,770,473 discloses a dispenser having a button which is adapted to actuate a compression means within the container body. When the button is pushed, it turns a threaded rod in the compression means. The button itself also turns. When the button is released, it turns further. One of the problems associated with this structure is that it is extremely difficult to operate the dispenser with one hand since the turning of the button requires the use of both hands, i.e. one hand to hold the button, and the other to steady the dispenser, making it extremely difficult to apply the extrudable material to an object such as a tooth brush which also must be hand held.

The structure disclosed in U.S. Pat. No. 1,802,113 is rather complex in appearance, number of parts and interconnection between the parts so that it would not be feasible to incorporate this structure into a device which could be sold to consumers and which could be discarded when the extrudable material is evacuated from the dispenser.

It is toward elimination of these and other difficulties that the present invention is directed.

SUMMARY OF THE INVENTION

1. Purposes of the Invention

It is an object of the present invention to provide a dispenser unit which will permit the dispenser to be grasped in a user's hand by use of the palm and fingers other than the thumb or the index finger and the dispensing of its contents by pressure applied with the thumb or index finger, all without complex manipulation of the dispensing unit.

Another object of the present invention is to provide a dispenser unit in which the amount of material dispensed with each actuation can be closely controlled.

Still another object of the present invention is to provide a dispenser unit in which a very large pressure can be applied to the contents within the container through the use of a force multiplier thereby permitting materials which are barely flowable to be dispensed by actuation with a single finger.

Yet another object of the present invention is to provide a dispenser unit in which the material dispensed can be maintained in a sanitary environment.

A further object of the present invention is to provide a dispenser unit having a disposable container adapted to hold an extrudable material with a releasably operatively connected actuation unit to permit the actuation unit to be reused with several disposable containers.

A still further object of the present invention is to provide a dispenser which can be easily and economically manufactured.

Other objects of the present invention in part will be obvious and in part will be apparent in the following description.

2. Brief Description of the Invention

Generally speaking, a dispenser unit in accordance with the present invention is provided with a container formed from an elongated tubular member having a constant transverse cross-sectional configuration which is adapted to hold an extrudable material. One end of the tubular member is sealed by an end wall which is provided with a discharge nozzle. A closure cap is adapted to selectively seal the discharge nozzle. The other end of the tubular member is provided with an airtight end wall. A compression means disposed within the container is adapted to exert an expelling or compression force on the extrudable material and includes a shaft having a threaded portion which extends axially down the center of the tubular member and which is permitted rotational non-longitudinal motion therein. One end of the shaft is spaced from and is in general alignment with the discharge nozzle. The shaft is journaled in the other end wall of the tubular member. A compression element corresponding to the internal shape of the tubular member has a threaded bore and is positioned on the threaded rod. The compression element is adapted to move longitudinally and non-rotatably within the tubular member as the threaded rod is rotated to exert an expelling, i.e. compression, force on the extrudable material within the tubular member.

An operating means is adapted for longitudinal non-rotational reciprocating motion with respect to a support means which is associated with the container. The operating means has an idle position and an actuated position with respect to the support means. The operating means is continually urged to its idle position.

A kinematic translating means is operatively coupled to the operating means and the compression means within the container and is adapted to translate the longitudinal motion of the operating means from its idle position to its actuated position to rotational motion of the threaded shaft to thereby cause a compression force to be exerted on the extrudable material. The kinematic translating means is adapted to prevent the rod from rotating when the operating means is returned to its idle position.

In one embodiment of the present invention, the container, support means, operating means and kinematic translating means are constructed as an integral unit which can be discarded after the extrudable material is evacuated from the container. In this embodiment the operating means is a button having an external configuration which is a general extension of the container and which is slidably mounted on an end portion of the container which forms the support means. The shaft extends through the end wall of the container and an opening in an internal thrust wall in the button. The shaft has a helical portion thereon which cooperates with a square central opening in an engagement which has recesses therein adapted to selectively frictionally engage recesses in the internal thrust wall. A coil spring biases the engagement against the internal thrust wall and the internal thrust wall against a flange on the end of the shaft. The button has an idle position on the support means and an actuated position in which it is urged inwardly, i.e. toward the container, on the support means and is constantly urged into the idle position. When the button is pressed inwardly on the end portion of the container, the recesses on the engagement frictionally engage the recesses on the internal thrust wall to prevent the engagement from rotating on the helical portion of the shaft. The shaft, therefore, rotates, causing the threaded portion to rotate, resulting in the compression element forcing an amount of the extrudable material through the discharge nozzle. When the pressure is removed from the button, the coil spring urges the button back to its idle position. The recesses on the engagement do not engage the recesses on the internal thrust wall and the engagement is permitted to move freely on the helical portion. The shaft does not rotate and consequently, no material is dispensed as the button returns to its idle position. A ratchet and pawl arrangement may be provided in operable engagement with the shaft to prevent the rotation of the shaft as the button returns to its idle position.

In an alternative embodiment, the support means, operating means and kinematic translating means are contained in an actuation unit which is, by means of a releasable interlocking connection, coupled to the container. The container is disposable to permit the actuation unit to be reused when the disposable container is emptied.

The actuation unit includes a base or support means to which the operating means in the form of a button housing is slidably mounted. The button housing has an idle position on the base and an actuated position in which it is displaced inward (toward the container) on the base. The button housing is constantly urged to the idle position by a coil spring. The base is coupled to the tubular member at the end opposite the discharge nozzle by a conventional bayonet coupling. Disposed within the base and button housing is a shaft having a helical portion. The shaft is operatively coupled to the compression means when the actuation unit is coupled to the container so that rotational motion of the shaft results in an expelling or compression force being exerted on the extrudable material.

A pair of uni-directional clutch assemblies in cooperation with the base, button housing, and the shaft control the movement of the shaft as the button housing is displaced on the base. A first clutch assembly includes a disc formed at the end of the shaft opposite the helical portion and is adapted to prevent rotation of the shaft when the button housing is moved from the actuated position to the idle position. A second clutch assembly includes a disc having a central square opening which cooperates with the helical portion of the shaft. The second clutch assembly is adapted to prevent the rotation of the disc on the helical portion of the shaft when the button housing is urged to its actuated position, i.e. inwardly on the base. The shaft therefore rotates, resulting in a compression force being exerted on the extrudable material. When the force urging the button housing inwardly on the base is removed, the coil spring urges the button housing to its idle position. The disc is permitted to ride freely on the helical portion to preclude rotation of the shaft. Consequently, no material is dispensed as the button housing returns to its idle position.

To use the dispenser, the closure cap is removed from the discharge nozzle and the dispenser unit held in the user's hand with the thumb resting on the operating means. By pressing the operating means inwardly, the compression means is activated to force an amount of the extrudable material from the container. Removal of the pressure on the operating means results in the operating means returning to its idle position. The compression element travels a predetermined specified distance within the container for each revolution of the shaft and the number of times the shaft rotates is dependent upon the distance the operating means is displaced inwardly on the support means. Therefore, a predetermined amount of extrudable material is discharged each time the operating means is displaced inwardly on the support means a predetermined distance.

The invention consists in the features of construction and arrangement of parts which will be detailed hereinafter and described in the appended claims.

BRIEF DESCRIPTION OF THE DRAWINGS

For a better understanding of the present invention, reference should be had to the accompanying drawings wherein like numerals of reference indicate similar parts throughout the several views and wherein.

DESCRIPTION OF THE PREFERRED EMBODIMENT

Figure 1:
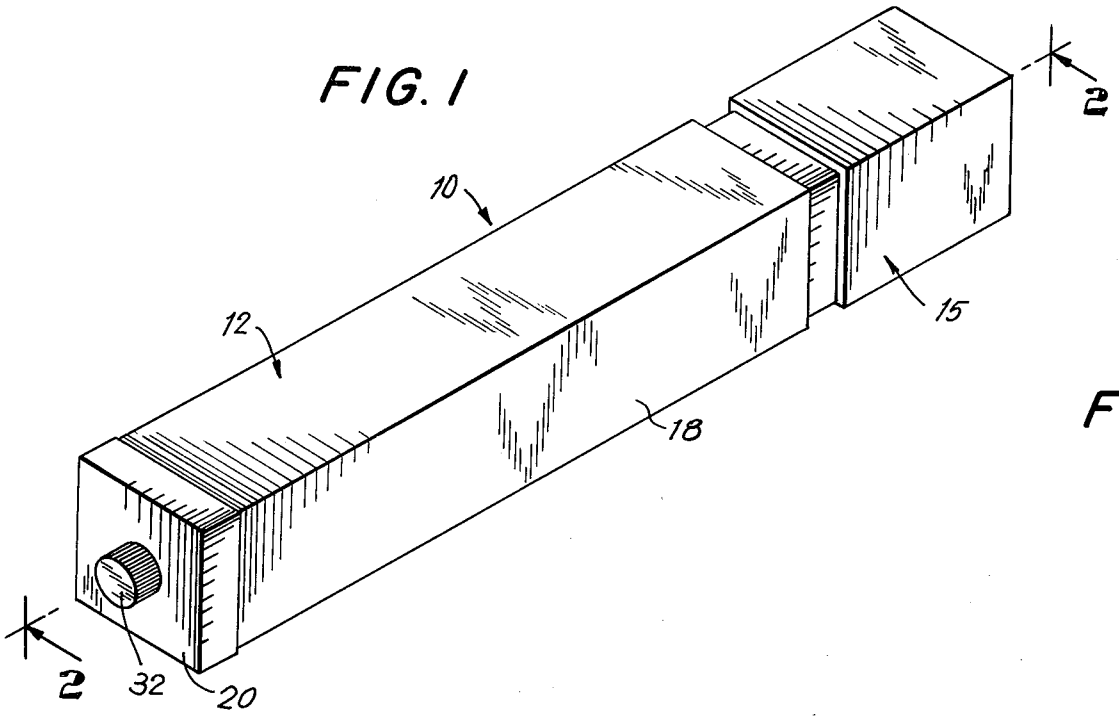
FIG. 1 is a perspective view of a dispenser in accordance with one embodiment of the present invention, the same being shown in a non-actuated condition.

Referring now specifically to the drawings, a dispenser unit in accordance with one embodiment of the present invention is illustrated in FIGS. 1 through 7 and is identified generally by the reference numeral 10. The dispenser unit 10 includes a container 12 which holds an extrudable material 13, a compression means 14 disposed within the container 12 for urging the extrudable material from the container and a longitudinally reciprocating operating means 15 operatively connected to the compression means through a kinematic translating means 16, each of which will be described hereinafter in detail. The extrudable material 13 is a semifluid, pastelike, flowable material e.g. ointments, creams, jellies, mustard, ketchup, mayonnaise, toothpaste, adhesives.

The various components of the dispenser unit 10 to be hereinafter described desirably are formed from inexpensive materials such as plastic when appropriate so that the dispenser will be inexpensive to manufacture and may be discarded after the extrudable material is discharged from the container.

Figure 4:
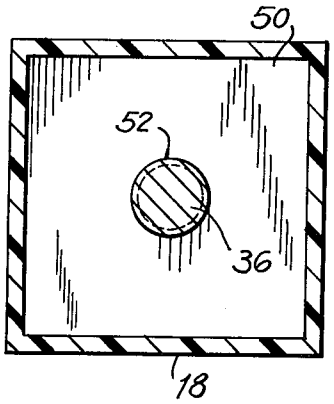
FIG. 4 is an enlarged sectional view taken substantially along the line 4—4 of FIG. 2.

The container 12 includes an elongated hollow or tubular member 18 which may be polygonal, oblong, oval or like (non-circular) transverse cross-sectional configuration and which is illustrated in FIG. 4 as being substantially square or rectangular in transverse configuration. The tubular member 18 may be opaque, or may be transparent to give the user a visual indication of how much extrudable material remains within the container.

A cap 20 is frictionally fixed on one end 22 of the tubular member 18. Alternatively the cap may be adhesively secured thereto or be formed as an integral part of the tubular member. The cap 20 is provided with an end wall 24 forming a closure for the container 12. The cap 20 has a centrally disposed discharge orifice 26 therein for discharging the extrudable material 13 therethrough. Projecting axially from the end wall 24 is a discharge nozzle 28 having an opening 29 by virtue of which the extrudable material 13 is discharged in a relatively small column for easy application to a desired location. While the transverse cross-sectional configurations of the discharge orifice 26 and the discharge nozzle 28 are shown as being circular, the configurations may be of other shapes, e.g. polygonal, to form the extruded material into other than a circular column e.g. a strip, as the extrudable material is forced therethrough. The discharge nozzle 28 has thread means 30 on its external surface. A closure cap 32 is provided with female thread means which is adapted to engage the thread means 30 to effectively seal the discharge nozzle 28 when the dispenser is not being used. The closure cap 32 not only prevents contamination of the extrudable material 13 during periods of non-use but also prevents drying out or hardening of the extrudable material such as might occur by air contact. Further, the closure cap 32 prevents any possibility of the extrudable material running out of or oozing from the nozzle 28 during periods of non-use.

While the closure cap is illustrated as having thread means which cooperate with thread means on the discharge nozzle to releasably secure the closure cap to the discharge nozzle to seal the container, it will be appreciated by those skilled in the art that the closure cap may be releasably secured to the discharge nozzle in other ways, i.e. the cap may be frictionally secured to the discharge nozzle, e.g. by a projection which is received within the discharge nozzle.

Disposed within the container 12 is the compression means 14 adapted to exert a compression force on the extrudable material 13 to urge the material through the discharge nozzle 28. The opposite end of the tubular member 18 is provided with an end wall 34 which may be integrally formed with the tubular member 18 and which seals the opposite end of the tube and renders it air-tight. Journaled in the end wall 34 is a shaft 36 having a first flange or washer 38 rotatably but non-axially slidable thereon and in engagement with the inner surface 40 of the end wall 34, and a second flange 42 in engagement with the outer surface 44 of the end wall 34. For reasons which will become apparent as the description proceeds the shaft 36 is precluded from longitudinal motion relative to the tubular member 18 by the interaction of the first and second flanges 38 and 42 and with the inner and outer surfaces 40 and 44 of the end wall 34 respectively. The shaft 36 extends axially down the center of the tubular member 18 and is externally screw threaded at the portion 46. The end 48 of the screw threaded portion 46 of the shaft 36 is spaced slightly from the closure wall 24 and generally is in axial alignment with the discharge orifice 26.

In threaded engagement with the threaded portion 46 of the shaft 36 is a compression element 50 corresponding in shape to the interior of the tubular member 18 (FIG. 4). The compression element 50 has a central tapped bore 52 which threadedly receives the screw threaded portion 46 of the shaft 36. Since the shape of the compression element 50 corresponds to the transverse cross-sectional configuration of the tubular member 18, when the threaded portion 46 of the shaft 36 is rotated by the operating means and the kinematic translating means as will hereinafter be described. The compression element 50 will be prevented from rotating and will be moved longitudinally along the portion 46 within the interior of the tubular member 18 to apply an expelling force to the extrudable material.

It will be appreciated by those skilled in the art that if the tubular member 18 is of a generally circular transverse cross-sectional configuration (not shown) projecting longitudinal ribs may be provided on the interior of the tubular member 18 which are adapted to engage with cooperating grooves on the periphery of the compression element 50 to prevent relative rotation between the compression element 50 and the tubular member 18 while permitting longitudinal movement of the compression element 50 within the tubular member 18.

Since the compression element 50 corresponds in peripheral configuration to the interior of the tubular member 18, as it advances longitudinally therein the extrudable material 13 will not pass between the compression element 50 and the interior wall of the tubular member 18. Optionally, the compression element 50 may be provided with sealing means (not shown) along its periphery to enhance the seal between the interior surface of the tubular member 18 and the compression element 50.

In the dispenser illustrated in FIGS. 1 through 7 the longitudinally reciprocating operating means 15 and the kinematic translating means 16 are designed as an integral part of the container 12. The operating means 15 includes a button 54 having side walls which constitute a generally smooth extension of the side walls of the container 12. The button 54 has an open ended portion 56 which is adapted to be slidably received on a support means created by a reduced end portion 58 of the container. The open ended portion 56 of the button 54 has an internal configuration corresponding to the outer surface of the end portion 58 so that, if the end portion 58 has an outer surface of other than a cylindrical configuration, the button 54 will be permitted longitudinal motion on the end portion 58 but will be precluded from rotational motion thereon. If the end portion 58 has an outer surface of a cylindrical configuration (not shown), the button may be precluded from rotation thereon by the interaction of projecting pins on the outer surface of the end portion 58 with grooves on the side wall of the button 56.

An internal transverse thrust wall 60 within the button 54 is provided with a centrally disposed circular opening 62 which passes the end portion 64 of the shaft 36.

Figure 2:
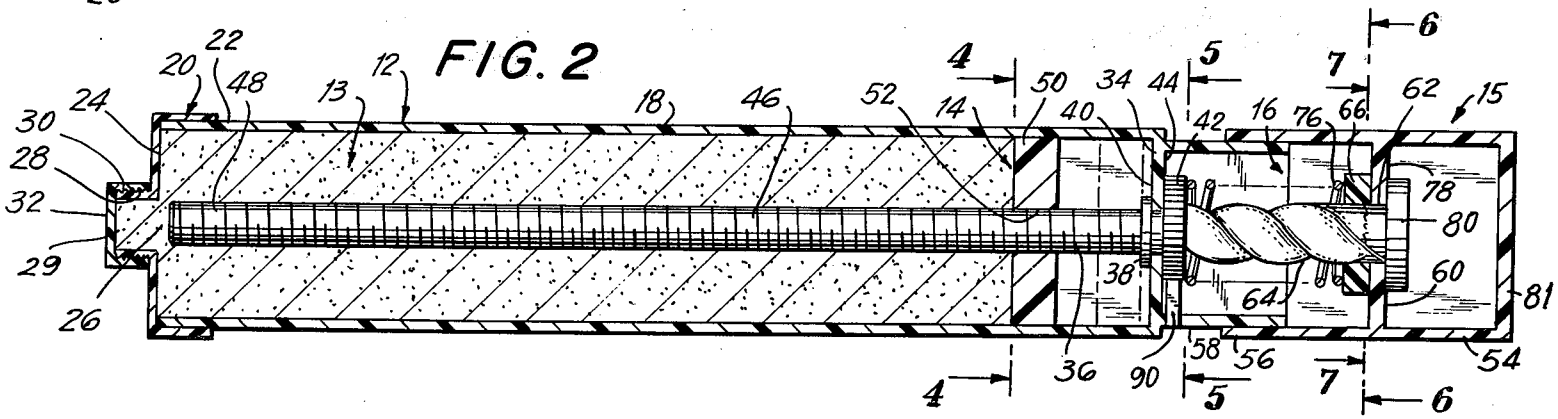
FIG. 2 is a sectional view taken substantially along the line 2—2 of FIG. 1.
Figure 3:
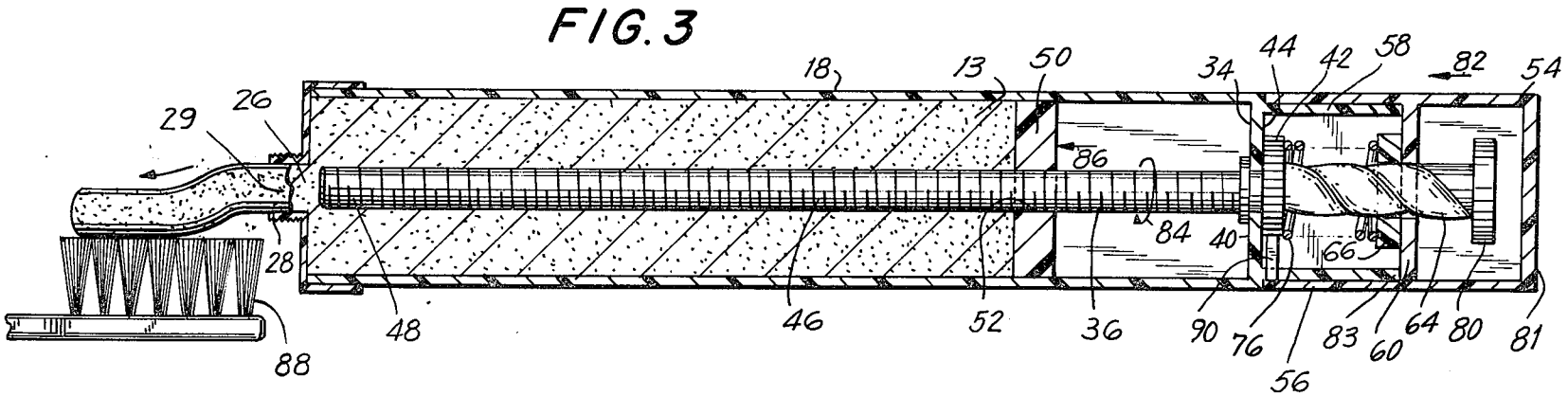
FIG. 3 is a view similar to FIG. 2 but showing the dispenser in actuated condition.
Figure 7:
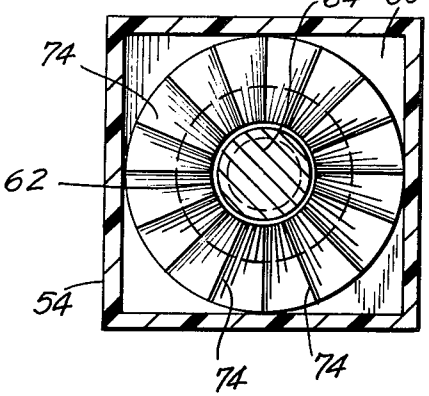
FIG. 7 is an enlarged sectional view taken substantially along the line 7—7 of FIG. 2.
Figure 6:
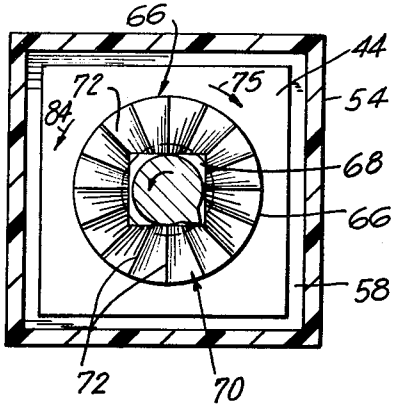
FIG. 6 is an enlarged sectional view taken substantially along the line 6—6 of FIG. 2.

A kinematic translating means in cooperation with the button and the shaft converts the inward longitudinal motion of the button inward on the end portion of the container to rotational motion of the shaft and permits the button to move outwardly on the end portion without rotation of the shaft. As best seen in FIGS. 2, 3, and 6, positioned on the portion 64 is a washer or engagement 66 having a square centrally disposed opening 68 therein. The end portion 64 of shaft 36 is in the shape of a helix, the cross section of which matches the square opening 68 in the engagement 66 (FIG. 6) for reasons which will become readily apparent. The face 70 of the engagement 66 is provided with a multiplicity of segmented radial buttress teeth 72 which are adapted to drivingly mesh with mating radial buttress teeth 74 (FIG. 7) on the internal wall 60 when the engagement 66 is urged in the direction of arrow 75 i.e. clockwise in FIG. 6 by the helical portion 64 as will hereinafter be described. If the engagement is urged in the opposite direction i.e. counterclockwise, the engagement will not drivingly mesh with the internal wall 60. A coil spring 76 is held under compression between the flange 42 and the engagement 66 and urges the engagement 66 against the internal wall 60 and consequently, the outer surface 78 of the internal wall 60 against the flange 80 at the end of the shaft 36. The button 54 therefore is always subjected to the force of the coil spring 76 urging it outwardly on the end portion 58 of the container 12.

The dispenser 10 is provided to the user or stored during periods of non-use with the operating means 15 in an idle position (FIG. 2), i.e. outwardly disposed on the end portion 58 in which the outer surface 78 of the inner thrust wall 60 is urged against the flange 80 at the end of the shaft 36 by the coil spring 76 and the discharge nozzle 28 is sealed by the closure cap 32. To dispense the extrudable material 13, the closure cap 32 is removed from the discharge nozzle 28 and the dispenser gripped in the palm of the user's hand with the thumb or index finger resting against the back wall 81 of the button 54. When an actuating force is exerted on the button 54 i.e. a force in the direction of arrow 82, the button is urged inwardly on portion 58 from the idle position to its inner or actuated position (FIG. 3). The actuating force exerted on the button must be sufficient to override the above-noted force of the coil spring 76. The button 54 can be displaced inwardly until a limitation on such movement becomes effective, e.g. until the end 83 of portion 58 abuts the internal thrust wall 60.

As the button is pushed inwardly, the engagement 66 is shifted along the helical portion 64. The interaction of the helical portion 64 with the square opening 68 in the engagement 66 applies a rotational force in the direction of arrow 75 (FIG. 6) to the engagement 66. The combination of the above-noted forces i.e. the applied inwardly directed force, the force of the coil spring 76 and the rotational force results in the erect faces of the buttress teeth 72 on the engagement 66 engaging the erect faces of the buttress teeth 74 on the internal thrust wall 60. The engagement 66 is thereby prevented from rotating on the helical end portion 64 of the shaft 36 as the button 54 moves inwardly. Consequently, the shaft 36 will rotate in the direction of arrow 84 counterclockwise in FIG. 3 due to the interaction of the helical portion 64 with the square opening 68 in the engagement 66. The number of degrees that the shaft 36 will rotate is dependent on the twist and length of the helix and the extent to which the button is shifted.

The rotation of the shaft 36 results in the compression element 50 advancing forward, i.e. toward the closure cap 20, along the screw threaded portion 46 of the shaft 36 as illustrated in FIG. 3 by arrow 86. An expelling or compression force is thereby exerted on the extrudable material 13 to urge a portion of the material through the discharge nozzle 28. As mentioned hereinabove, by virtue of the discharge nozzle 28 a relatively slender column of the material is extruded for easy application to a desired location which may be, for example, the bristles of a toothbrush 88 if the extrudable material is toothpaste as shown.

The distance the compression element 50 travels along the threaded portion 46 of shaft 36 and consequently the amount of material dispensed, is directly dependent on the pitch of the threads on the portion 46 and the number of degrees the shaft 36 is rotated. For each actuation or displacement of the button 54 a specified distance on the portion 58, a predetermined amount of material will be dispensed through the discharge nozzle 28. In other words, the amount of material disposed each time the button is depressed is metered.

As mentioned hereinabove, the kinematic translating means permits rotation of the shaft only when the button is urged inwardly on the end portion 58. When the actuating force is removed from the button 54, the coil spring 76 urges the button outwardly on the end portion 58 to its idle position. The button 54 is urged outwardly on the end portion 58 of the container 12 until the surface 78 again abuts the flange 80. As the engagement shifts outwardly, it rotates reversely along the helix. This rotation is relative to the surface 78 and the teeth 74 and takes place as the sloped faces of the teeth 72 ride along the sloped faces of the teeth 74. In effect, accordingly the teeth 72, 74, the helix 64 and the spring 76 act as a uni-directional drive or clutch that enables the shaft 36 to be rotated as the button is depressed and enables the button to retract, without turning, when the button is released. The compression element 50 does not move longitudinally within the tubular member when the button is released so that extrudable material is not urged from the container. Thus, extrudable material is dispensed only when the button is displaced inwardly from its idle position.

Figure 5:
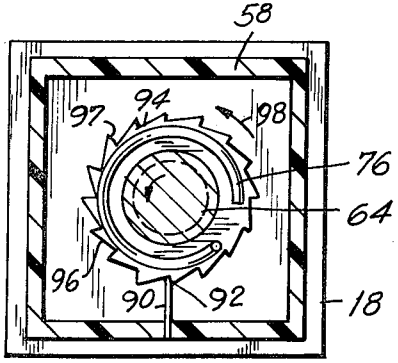
FIG. 5 is an enlarged sectional view taken substantially along the line 5—5 of FIG. 2.
Figure 8:
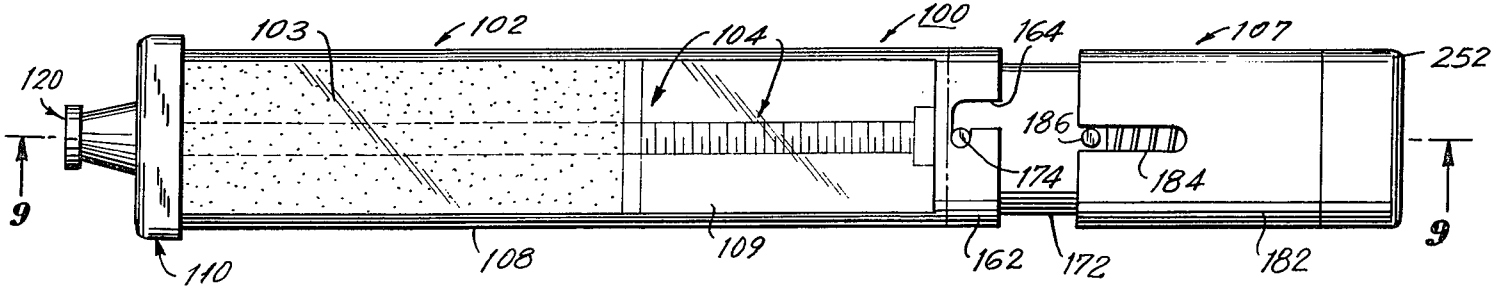
FIG. 8 is a side view of a dispenser in accordance with an alternative embodiment of the present invention, the same being shown in a non-actuated condition.

To insure further that the shaft 36 does not rotate as the button is returned to its idle position, a ratchet and pawl arrangement may be placed in operative engagement with the shaft 36. One such arrangement is illustrated in FIG. 5 and includes a spring pawl 90 adjacent to the outer surface 44 of the end wall 40. The spring pawl 90 has a tip 92 which cooperates with a multiplicity of buttress teeth 94 on the periphery of flange 42 that is fixed to the shaft 36. Each tooth has a sloped side 96 and a side 97 extending radially outwardly from the center of the flange 42. When the button 54 is urged inwardly on the portion 58, the flange 42 will rotate in the direction of arrow 98 and the tip 92 will ride along the sloping sides 96 of the teeth 94 so as not to oppose the rotation of shaft 36. When the button 54 is urged back to its idle position, the shaft 36 is precluded from rotating in a direction opposite to the arrow 98 by the interaction of the tip 92 with the side 97 of one of the teeth on the flange.

The above description details an embodiment of the present invention in which the dispenser unit includes a container and an integral operating and kinematic translating means which is disposable. The following decription relates to an alternative embodiment of the present invention in which the dispenser unit includes a disposable container with the operating and kinematic translating means being contained in a unit separable therefrom by means of a releasable interlocking connection to permit the unit to be reused or used with other disposable containers.

A dispenser unit 100 in accordance with the alternative embodiment of the present invention is illustrated in FIGS. 8 through 13 and includes a disposable container 102 adapted to hold extrudable material 103 having a compression means 104 therein adapted to urge the extrudable material 103 from the container 102. The unit further includes a longitudinally reciprocating operating means 105 operatively coupled to the compression means through a kinematic translating means 106. The longitudinally reciprocating operating means 105 and the kinematic translating means 106 are contained in an actuation unit designated 107 which is detachable from the disposable container 102 as will hereinafter be described.

The disposable container 102 is similar in construction to container 12 mentioned hereinabove and includes an elongated hollow tubular member 108 formed from an inexpensive material, e.g. plastic, which is illustrated as being square or rectangular in transverse cross-sectional configuration. The tubular member 108 may be of other transverse cross-sectional configuration, i.e., polygonal, oblong or oval. The tubular member 108 may be opaque or may have at least one transparent side wall 109 to give the user a visual indication of how much material remains in the container. One end of the tubular member 108 is sealed by a cap 110 which is frictionally fixed on the tubular member 108 or alternatively may be integrally formed therewith. The cap 110 is provided with an end wall 112 having a centrally disposed discharge orifice 114 therein. Projecting axially from the end wall 112 is a discharge nozzle 116 having an opening 117 therethrough by virtue of which the extrudable material is discharged in a relatively slender strip for easy application to a desired location. The discharge nozzle 116 frictionally receives a plug 118 of a closure cap 120 to effectively seal the discharge nozzle 116 when the dispenser is not being used so as to prevent contamination of the extrudable material, drying out or hardening of the extrudable material and running out or oozing of the extrudable material from the nozzle 116. The discharge nozzle 116 alternatively, may be sealed by providing thread means on its external surface and by providing a closure cap with female thread means which are adapted to engage the thread means on the discharge nozzle as illustrated in the first embodiment described hereinabove.

The compression means 104 in accordance with the alternative embodiment is also similar to that disclosed in the embodiment described above. At the opposite end of the tubular member 108 is an end wall 122 which may be integrally formed therewith and which seals the container 102 and renders it airtight. The end wall 122 has a centrally disposed bore 123 therein.

A coupling flange 124 has a short shaft 126 with a central bore 127 therethrough. The short shaft 126 is journalled in the bore 123 to allow the coupling flange rotational motion with respect to the end wall 122. Extending axially along the center of the tubular member 108 is a threaded shaft 128 having one end 130 which is spaced slightly from the closure wall 112 and generally is in alignment with the discharge orifice 114. The other end 132 of the threaded shaft 128 is tapped and is received in a counterbore 134 in a washer 136. The washer 136 has a central bore 137 in axial alignment with the central bore 127 and engages the inner surface 138 of the end wall 122 and the end face of the shaft 126. The threaded shaft is fixedly secured to the coupling flange 124 by a screw 140 which extends through the central bores 127 and 137 and which is received in the tapped end 132. Thus, when the coupling flange 124 is rotated by the kinematic translation means 106 as will hereinafter be described in detail, the threaded rod 128 rotates therewith.

In the threaded engagement with the threaded rod 128 is a compression element 150 corresponding in shape and size to the interior of the tubular member 108. The compression element 150 has a central tapped bore 152 which threadably meshes with the threaded shaft 128. Since the shape of the compression element 150 corresponds to the interior of the tubular member, when the threaded shaft 128 is rotated in a given direction by the kinematic translating means as described hereinafter, the compression element can not rotate but will move longitudinally forward within the interior of the tubular member 108 toward the closure wall 112, applying an expelling or compression force on the extrudable material 103.

As mentioned hereinabove regarding the first embodiment disclosed, if the tubular member 108 is of a circular transverse cross-sectional configuration means may be provided to prevent relative rotation of the compression element 150 on the threaded shaft 128. Further, additional sealing means, e.g. an o-ring, may be provided to insure that none of the extrudable material passes between the periphery of the compression element 150 and the interior surface of the tubular member 108 as the compression element advances within the tubular member.

The operating means 105 and the kinematic translating means 106 which will be described hereinafter in detail are contained within the actuation unit 107 which is structured to be releasably coupled to the disposable container 102 so that when the material 103 is evacuated from the container 102, the actuation unit 107 may be disengaged therefrom and positioned on another full contaier. Further, the actuation unit 107 can thus be used with several disposable containers if so desired.

The actuation unit 107 includes a base or support means 160 on which the operating means 105 is mounted and which contains a portion of the kinematic translating means 106. The actuation unit 107 is coupled to the disposable container 102 by a releasably interlocking connection illustrated as a bayonet coupling. A cylindrically shaped wall 162 extends from the tubular member 108 to form a socket at the end of the tubular member. The cylindrically shaped wall 162 is provided with diametrically opposed "L" shaped bayonet slots 164. The base 160 has a smooth cylindrical outer surface 172 dimensioned to be slidably received within the cylindrically shaped wall 162, said base provided with diametrically opposed bayonet pins 174 extending through openings 175 in the outer surface. The pins 174 are illustrated as being individual elements inserted through the openings 175 but it is to be understood that they may be formed as an integral part of the base 160. To releasably couple the actuation unit 107 to the container 102, the base 160 is slipped into the socket created by the cylindrically shaped wall 162 with the pins 174 cooperating with the longer legs of the bayonet slots 164. The actuation unit 107 is then rotated within the cylindrically shaped wall 162 in the direction of the arrow 176 in FIG. 10 until the pins 174 are fully received in the short legs of the bayonet slots 164 to lock the actuation unit 107 to the container 102. The bayonet slots may be so positioned in the cylindrical wall that when the base is fully received in the cylindrical wall, its end face 178 abuts the end wall 122.

The operating means 105 includes a button housing 180 having a cylindrical side wall 182 which forms a general extension of the cylindrical wall 162, said housing being slidably mounted on the base 160. The interior wall configuration 183 of the button closing 180 conforms to the shape of the cylindrical outer wall surface 172 so that the button housing 180 is permitted limited longitudinal movement thereto. The button housing 180 is precluded against rotational movement on the base 160 by the interaction of a pair of diametrically opposed longitudinal slots 184 in the side wall 182 and a pair of pins 186 extending from the cylindrical outer wall surface 172 of the base. While the pins 186 are illustrated as being separate elements inserted through openings 188 in the outer wall surface 172, it is to be understood that the pins may be formed as an integral part of the base 160.

The kinematic translating means 106 in cooperation with the button housing 180, the base 160 and the coupling flange 124 converts longitudinal motion of the button housing on the base 160 to rotational motion of the coupling flange 124 to thereby longitudinally displace the compression element 150 within the tubular member 108.

In order to fully understand the operation of the kinematic translating means, the various components included therein will be described first, followed by a detailed discussion of their interaction.

Disposed within the base 160 and the button housing 180 is a central shaft 190 having a central bore 191 therethrough and a helical portion 192 at one end, said helical portion being of square cross-section. In operable communication with the shaft 190 at opposite ends of the helical portion are uni-directional drive or clutch assemblies which control the rotation of the shaft 190. A first roller clutch assembly 194 best seen in FIG. 13 includes a disc 196 fixed on the shaft 190 and has a periphery which conforms to the transverse cross-sectional configuration of the base 160 and which is dimensioned to permit the disc 196 to freely rotate within the base 160. Thd disc 196 has three wedge-shaped peripheral pockets 198 therein adapted to receive cylindrical rollers 200. When the actuation unit 107 is assembled as described hereinbelow, the rollers 200 contact the interior wall surface 201 of the base 160 and the walls 202 and 203 of the pockets. The first roller clutch assembly is adapted to permit the central shaft 190 to rotate in the direction of arrow 204, i.e. clockwise in FIG. 13 and to prevent the shaft from rotating in the opposite direction, i.e. counterclockwise. When the shaft 190 is urged in the direction of arrow 204, the rollers 200 are permitted to rotate freely in the pockets to allow the shaft to rotate. When the shaft 190 is urged in the opposite direction, the rollers 200 cannot rotate because of the interaction of the friction forces exerted on the rollers 200 by the sides 202 and 203 and the interior wall 201 of the base 160. The rollers 200 jam and oppose the rotation of the shaft 190.

Figure 11:
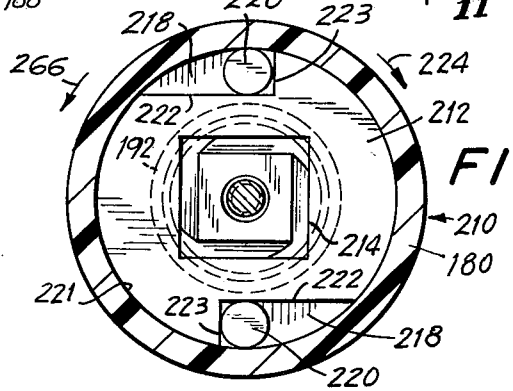
FIG. 11 is a sectional view taken substantially along the line 11—11 of FIG. 9.

A second roller clutch assembly 210 which is illustrated in FIG. 11 is in operable communication with the helical portion 192 of shaft 190. The second roller clutch assembly includes a disc 212 having a square centrally disposed opening 214 therein, the cross-section of which matches the helical portion 192 on shaft 190. The periphery of the disc 212 conforms to the transverse cross-sectional configuration of the button housing 180 so that the disc may rotate therein. The periphery of the disc 212 is provided with wedge-shaped pockets 218 therein which are adapted to receive cylindrical rollers 220. The rollers 220 contact the interior wall surface 221 of the button housing 180 and the sides 222 and 223 of the pockets 218. The rollers 220 cooperate with the interior wall surface 221 and the sides 222 and 223 to preclude rotation of the disc 212 when it is urged in the direction of arrow 224, i.e. clockwise and to permit rotation of the disc 212 when it is urged in the opposite direction for reasons which will hereinafter become apparent.

To assemble the actuation unit 107, the first roller clutch assembly 194 is inserted into the base 160 until the face 225 of the disc 196 abuts an internal transverse bearing wall 226 within the base 160. The rollers 200 will be trapped between the wall 226 and the back wall 227 of the pockets 198. A coil spring 230 is then positioned on the shaft 190 with one end bearing against the disc 196. The second roller clutch assembly 210 is then positioned within the button housing 180 with the face 232 of the disc 212 engaging a thrust wall 234 positioned within the button housing 180. The rollers 220 are trapped between the thrust wall 234 and the back walls 235 of the pockets 218. The button housing 180 is then slipped onto the end of the base 160 so that the pins 186 are received within the longitudinal slots 184 and the helical portion 194 is received within the square central opening 214 in the disc 212 of the second clutch assembly 210. A washer 236 having a central aperture 238 therethrough is then inserted within a counterbore 240 in the transverse internal thrust wall 234. Next a screw 242 is inserted through the central aperture 238 and screwed into the central bore 197 through the shaft 190. A coupling nut 244 having a flange 246 with a centrally disposed rearward projection 248 is threaded onto the forward end of the screw 242. The projection 248 is journaled within a central bore 250 in the transverse internal bearing wall 226 and has its rear end received within the disc 196.

Figure 9:
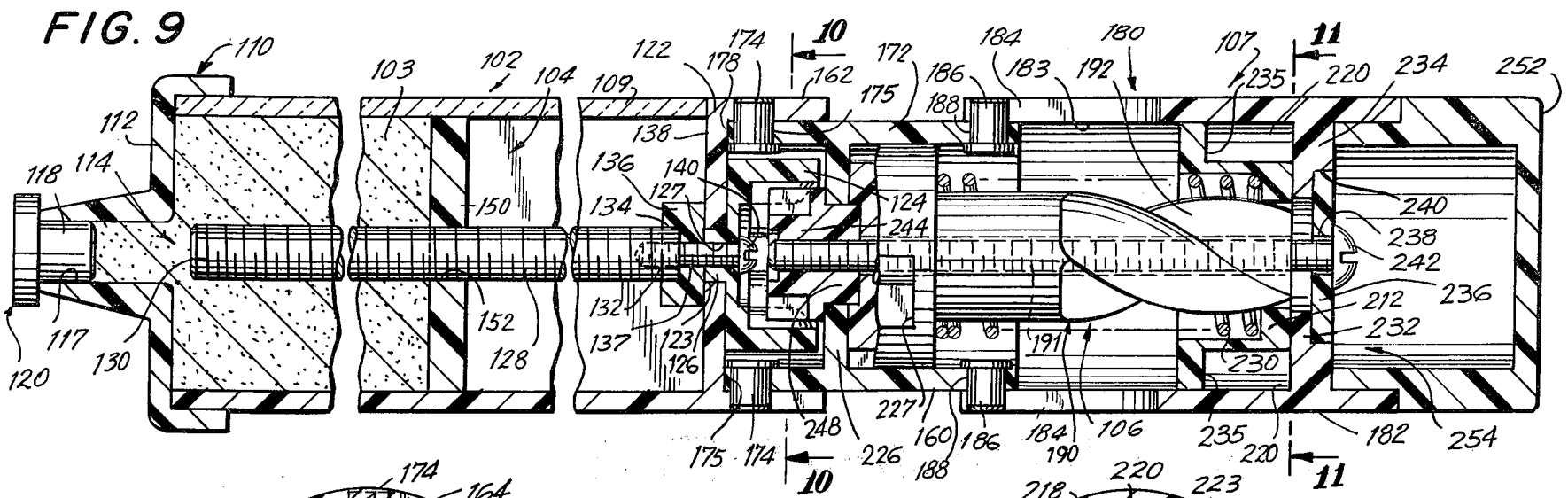
FIG. 9 is an enlarged partial sectional view taken substantially along the line 9—9 of FIG. 8.

The coil spring 230 within the button housing serves to constantly urge the disc 212 against the thrust wall 234 within the housing and consequently, the housing 180 is always being urged against the washer to an idle position outward on the base 160 as best seen in FIG. 9.

A closure cap 252 is frictionally received in the open end 254 of the button housing 180 and serves to seal the open rear end of the button housing to provide a bearing surface and to make the actuation unit 107 aesthetically pleasing.

Figure 10:
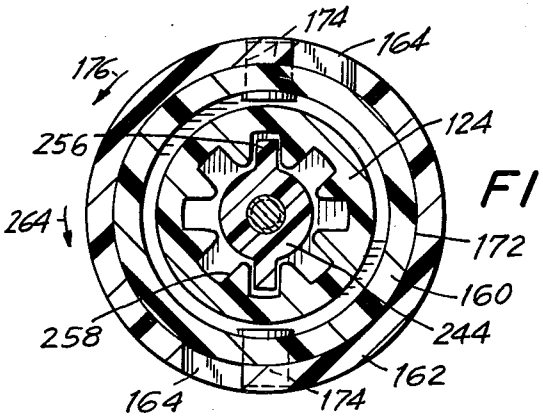
FIG. 10 is a sectional view taken substantially along the line 10—10 of FIG. 9.
Figure 12:
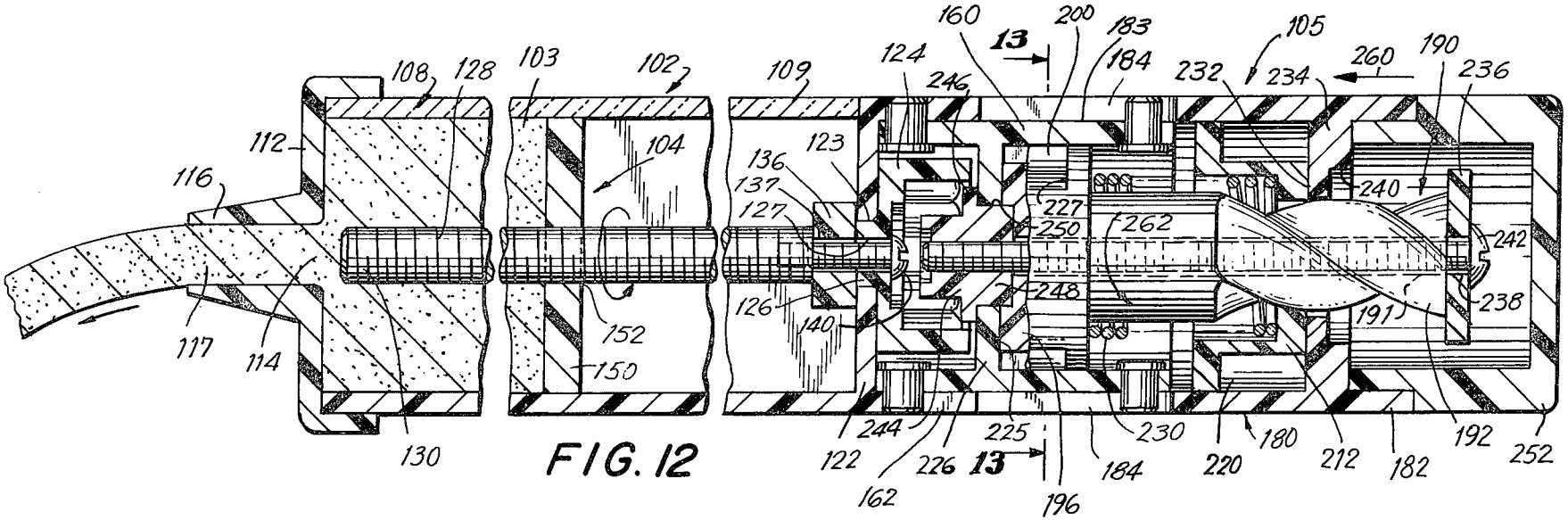
FIG. 12 is a sectional view similar to FIG. 9 showing the dispenser in accordance with the alternative embodiment of the present invention in an actuated condition.
Figure 13:
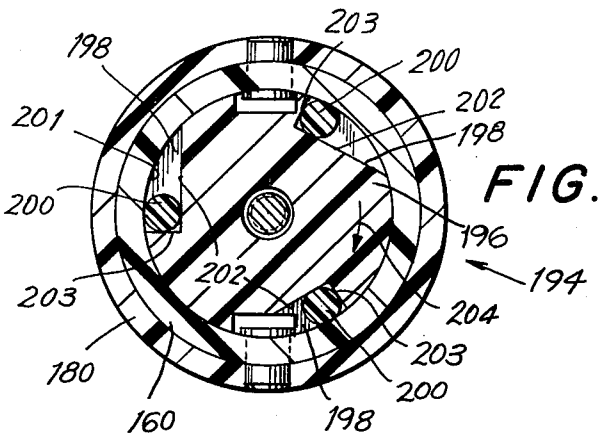
FIG. 13 is a sectional view taken substantially along the line 13—13 of FIG. 12.

When the actuating unit 107 is connected to the disposable container 102 by the releasably interlocking engagement, the operating means 105 is in its idle position and the kinematic translating means is operatively coupled to the shaft within the disposable container through the engagement of radial projections 256 on the coupling nut 244 with radially extending projection receiving grooves 258 in the coupling flange 124 (FIG. 10). Therefore, rotational motion of the coupling nut 244 as will be hereinafter described, will result in rotational motion of the coupling flange 124 and the rod 128.

To dispense the extrudable material 103 from the disposable container 102, the closure cap 120 is first removed from the discharge nozzle 116 and the dispenser unit 100 is held in a user's hand with the user's thumb resting on the closure cap 252. An actuating force is applied to the button housing in the direction of arrow 260 in FIG. 12 to urge the button housing 180 from its idle position longitudinally inwardly on the base 160 until the pins 186 strike the ends of the slots 184 in the side wall 182. Obviously, this actuating force must be sufficient to overcome the outwardly directed force of the coil spring 230. When the actuating force is applied to the button housing 180, the engagement of the helical portion 192 with the square opening 214 in the disc 212 will cause the disc to be urged in the direction of arrow 224 (FIG. 11). As mentioned hereinabove, the second clutch assembly opposes rotation of the disc 212 in the direction of arrow 224 by the interaction of the rollers 220 with the interior surface 221 of the housing 180 and the sides 222 and 223 of the pockets 218. Since the disc 212 is precluded from rotational motion, the central shaft 190 will rotate in the direction of arrow 262 in FIG. 12 i.e. counterclockwise due to the interaction of the helical portion 194 and the square central opening 214 as the button housing 180 moves inwardly. The structure of the first clutch assembly as metioned above does not prevent the rotation of the central shaft 190 in the direction of the arrow 204 i.e. clockwise in FIG. 13. The rotation of the central shaft 190 results in the rotation of coupling nut 244 and the coupling flange 124 in the counterclockwise direction of arrrow 264 in FIG. 10. As the coupling flange 124 rotates, the threaded rod 126 rotates counterclockwise causing the compression element 150 to move longitudinally forward, i.e. toward the discharge orifice 114 within the tubular member 108. An expelling or compression force is thereby exerted on the extrudable material 103 to thereby urge a portion of the extrudable material through the discharge nozzle 116.

It will be appreciated that the amount of rotation of the central shaft 190 depends upon the twist of the helical portion 192 and that the distance the compression element 150 travels within the tubular member 108 and consequently the amount of material dispensed is directly dependent on the pitch of the threads on rod 128 and the number of degrees the shaft 190 rotates. The amount of material dispensed each time the button is depressed is metered so that for each actuation a predetermined amount of material is forced through the discharge nozzle for a full forward stroke of the button.

When the actuating force is removed from the button housing 180, the force of the coil spring 230 urging the button housing 180 outward on the base 160 will be unopposed and the button housing 180 will return to its idle position. As the button housing 180 moves outward on the base 160, the disc 212 will be urged in the direction of arrow 266 (FIG. 11) by the interaction of the square opening 214 with the helical portion 192. As mentioned hereinabove the rollers will not oppose rotation in this direction, hence the disc 212 rotates or rides freely on the portion 192 as the button housing returns to its idle position under the force of spring 230 and the shaft 190 remains motionless. The first clutch assembly prevents rotation of the central shaft 190, in a direction opposite arrow 264, i.e. clockwise to insure the extrudable material is dispensed only when the button housing is subjected to an actuating force.

It can be seen from the foregoing that the objects of the present invention, namely, to provide a dispenser unit which will dispense a metered amount of extrudable material and which can be held and actuated in a user's hand has been accomplished by a dispenser unit having a container formed from a tubular member which is adapted to hold an extrudable material. One end of the tubular member is closed by an end wall having a discharge nozzle therein. The discharge nozzle can be releasably sealed by a closure cap. The other end of the tubular member is sealed by an air-tight end wall. Disposed within the tubular member is a compression means which when activated exerts an expelling or compression force on the extrudable material held in the container. The compression means includes a threaded shaft which is adapted for rotational non-longitudinal motion within the tubular member. The shaft is journaled in the air-tight end wall of the tubular member and one end of the shaft is spaced from and in general alignment with the discharge nozzle. A compression element threadily engages a threaded portion of the shaft and is adapted to move longitudinally within the tubular member as the shaft rotates. An operating means is adapted for limited longitudinal non-rotational motion on a support means adjacent to the air-tight end wall of the container and has an idle position and an actuated position on the support means. A kinematic translating means in operative engagement with the operating means and the compression means is provided to convert the longitudinal non-rotational motion of the operating means as it is displaced from its idle position to its actuated position to rotational motion of the shaft.

In one embodiment, the container, the support means, the operating means and the kinematic translating means are integral parts of the dispenser. In this embodiment the kinematic translating means includes a helical portion of the shaft which extends into the operating means. The helical portion is received within an engagement which is adapted to cause rotation of said shaft as said operating means is displaced inwardly on the support means. The engagement is adapted to prevent rotation of the shaft as the operating means returns to the idle position. When the extrudable material is evacuated from the container, the dispenser unit can be discarded.

In an alternative embodiment, the support means, the operating means and the kinematic translating means are contained in an actuation unit which through a releasable interlocking connection is coupled to a container which is disposable when emptied of extrudable material. The actuating unit can be reused with other containers. In this embodiment the kinematic translating means includes a pair of uni-directional clutch assemblies. One clutch assembly is adapted to cause rotational motion of the shaft when the operating mechanism is displaced inwardly on the support means. The other clutch assembly is adapted to oppose rotation of the shaft as the operating means returns to its idle position.

To use the dispenser unit, the unit is held in the user's hand with the thumb resting on the operating means. When the operating means is urged inwardly from its idle position, the kinematic translating means causes the shaft to rotate resulting in an expelling or compression force being exerted on the extrudable material forcing it through the discharge nozzle. When the thumb pressure is removed from the operating means, said means returns to its idle condition and the kinematic translating means prevents rotational motion of the shaft to preclude undesired expulsion of the extrudable material.

While in accordance with the patent statutes a preferred and alternative embodiment have been illustrated and described in detail, it is to be particularly understood that the present invention is not limited thereto or thereby.

What is claimed is:

1. An apparatus for dispensing extrudable materials, said apparatus comprising:

a. an elongated container means for holding a quantity of extrudable material, said container means including one end wall with a discharge nozzle having an opening through which said extrudable material is dispensed, said container means including another end wall remote from said one end wall;

b. compression means within said container means for compressing said extrudable material to force said extrudable material through said opening in said discharge nozzle, said compression means having a threaded rotatable shaft along which a compression element in non-rotatable cooperation with said container moves when rotatable motion is imparted to said shaft so that said compression element thereby is longitudinally displaced within said container means;

c. a support means adjacent said another end wall, said support means extending from said another end wall in a direction away from said container means and said support means being of constant transverse cross-sectional configuration;

d. an operating means mounted for longitudinal non-rotational motion on said support means, said operating means having an idle position and an actuated position in which latter position it is displaceable inwardly on said support means, said operating means further including a biasing means to urge the operating means to said idle position, said operating means having an open end portion with an internal configuration corresponding to the outer surface of the support means and telescopicable thereover; and e. kinematic translating means operatively coupling said operating means to said compression means and constructed to transduce the longitudinal non-rotational motion of said operating means as it is displaced from said idle position to said actuated position on said support means into rotational motion to rotate said shaft in one direction so as to forwardly displace said compression element within said container and thereby dispense said extrudable material, said kinematic translating means preventing reverse rotational motion of said shaft when said operating means returns from said actuated position to said idle position, said kinematic translating means comprising a second shaft having a helical portion at one end disposed within said operating means and coaxial with said threaded shaft, an engagement adapted to drivingly engage an interior wall of said operating means when said operating means is urged from its idle position inwardly on said support means, said engagement having a centrally disposed opening therein rideable on and adapted to matingly engage said helical portion of said second shaft so that as said operating means is urged inwardly on said support means said second shaft will rotate, said engagement adapted to freely rotate on said second shaft as said operating means is urged to said idle position so that said engagement will not cause rotational motion of said second shaft as said operating means is restored to idle position.

2. An apparatus in accordance with claim 1 wherein said kinematic translating means further includes a ratchet and pawl means in operative engagement with said shaft to further preclude rotation of said shaft as said operating means is returned to said idle position.

3. An apparatus in accordance with claim 1 wherein said support means, said operating means and said kinematic translating means are contained in an actuation unit and further comprising a releasable interlocking means for releasably connecting said actuation unit to said container means.

4. An apparatus in accordance with claim 3 wherein said support means comprises a base, said operating means being slidably mounted on said base and said kinematic translating means comprises a shaft having a helical portion thereon and a pair of unidirectional drive assemblies, the first said pair of unidirectional drive assemblies adapted to prevent rotation of said shaft as said operating means is urged into its idle position and a second of said pair of uni-directional drive assemblies adapted to engage said helical portion of said shaft to cause rotational motion of said shaft as said operating means is urged inwardly on said base.

5. An apparatus for dispensing extrudable materials comprising:

a. an elongated container means for holding a quantity of extrudable material including one end wall with a discharge nozzle having an opening through which said extrudable material is dispensed and another end wall;

b. compression means within said container means for compressing said extrudable material to force said extrudable material through said opening in said discharge nozzle, said compression means having a threaded rotatable shaft along which a compression element in non-rotatable cooperation with said container moves when rotational motion is applied to said shaft so that said compression element is longitudinally displaced within said container means;

c. a support means adjacent said another end wall;

d. an operating means mounted for longitudinal non-rotational motion on said support means, said operating means having an idle position and an actuated position in which latter position it is displaced inwardly on said support means and is biased to said idle position;

e. kinematic translating means operatively coupling said operating means to said compression means and constructed to transduce the longitudinal non-rotational motion of said operating means as it is displaced from said idle position to said actuated position on said support means into rotational motion to rotate said shaft in one direction to forwardly displace said compression element within said container, said kinematic translating means preventing reverse rotational motion of said shaft when said operating means returns from said actuated position to said idle position; and f. said support means, said operating means and said kinematic translating means being contained conjointly in an actuation unit, said container means and said compression means constituting a unit separate from said actuation unit, and a releasable interlocking means for releasably connecting said actuation unit to said separate unit.

* * * * *